United States Patent [19]

Kaufman

[11] Patent Number: 4,624,459

[45] Date of Patent: Nov. 25, 1986

[54] GAMING DEVICE HAVING RANDOM MULTIPLE PAYOUTS

[75] Inventor: Clarence D. Kaufman, Las Vegas, Nev.

[73] Assignee: Bally Manufacturing Corporation, Chicago, Ill.

[21] Appl. No.: 775,178

[22] Filed: Sep. 12, 1985

[51] Int. Cl.[4] ..... G07F 17/34

[52] U.S. Cl. ..... 273/143 R; 273/138 A

[58] Field of Search ..... 273/138 A, 143 R; 364/412

[56] References Cited

U.S. PATENT DOCUMENTS

| | | | |
|---|---|---|---|
| 3,684,290 | 8/1972 | Wayne . | |
| 3,852,576 | 12/1974 | Rudd | 273/138 A X |
| 3,918,716 | 11/1975 | Nonaka et al. . | |
| 4,095,795 | 6/1978 | Saxton et al. | 273/143 R |
| 4,095,824 | 6/1978 | Bachman . | |
| 4,099,722 | 7/1978 | Rodesch et al. . | |
| 4,101,129 | 7/1978 | Cox . | |
| 4,238,127 | 12/1980 | Lucero et al. . | |
| 4,299,388 | 11/1981 | Resch et al. . | |
| 4,508,345 | 4/1985 | Okada . | |

FOREIGN PATENT DOCUMENTS

| | | | |
|---|---|---|---|
| 0142371 | 5/1985 | European Pat. Off. . | |
| 2938307 | 4/1981 | Fed. Rep. of Germany | 273/143 R |
| 3017408 | 11/1981 | Fed. Rep. of Germany | 273/138 A |
| 2096376 | 10/1982 | United Kingdom | 273/143 R |
| 2147442 | 5/1985 | United Kingdom . | |

*Primary Examiner*—Richard C. Pinkham
*Assistant Examiner*—Stuart W. Rose
*Attorney, Agent, or Firm*—Jenner & Block

[57] ABSTRACT

A gaming device having random multiple payouts. The device has a random number generator which generates a multiple payout random number. The device further includes a counter for accumulating the number of game wins. When the multiple payout random number equals the number of accumulated wins in the counter, a multiple payout is made for a winning game. The device also includes a multiple payout indicator to provide an indication to the player that a multiple payout will be made for the next winning game.

12 Claims, 3 Drawing Figures

GAMING DEVICE HAVING RANDOM MULTIPLE PAYOUTS

FIELD OF THE INVENTION

The present invention relates to gaming devices and more particularly to gaming devices having random multiple payouts.

BACKGROUND OF THE INVENTION

There are several widely known gaming devices having three to five rotatable reels arranged side-by-side. The outer peripheral surface of the reels have placed thereon a series of symbols, such as a lemon, a cherry, a bar, or the like. Recently, machines having a video display instead of physical reels have become popular.

In both the mechanical and video type gaming devices, the player inserts a token, which may be a coin or the like, into the machine and starts the reels in motion by pulling a handle located on the side of the machine. After the reels have spun for a predetermined length of time (usually determined by a random number generator), they are stopped to display the symbols. At that time, a determination is made as to whether the combination of the displayed symbols matches a predetermined combination. If a match is sensed, the machine will payout a number of tokens in relation to the odds that the particular combination would occur.

In some existing gaming devices more than one token can be inserted by the player. In which case, the payout made for a winning symbol combination is based not only upon the odds that the particular combination would occur, but also upon the number of inserted tokens. For example, if a particular winning symbol combination pays three tokens for one inserted token, the same winning combination would pay six tokens for two inserted tokens. This is sometimes referred to a multiple payout feature.

The multiple payout feature in existing gaming devices is based only upon the number of inserted tokens. In order to increase the excitement of playing gaming devices, it is desirable to provide a device wherein a multiple payout is made random.

SUMMARY OF THE INVENTION

It is therefore an object of the present invention to provide a gaming device wherein a multiple payout is made for a winning symbol combination on a random basis.

It is a further object of the present invention to provide a gaming device of the type described wherein the device provides an indication to a player that a multiple payout will occur on the next win.

It is a related object of the invention to provide the player with an indication of the number of winning games which must be accumulated before a multiple payout is made for a win.

In accordance with these and other objects of the invention, the gaming device of the present invention has a game controller which includes a win control for determining whether the symbol bearing reels have stopped in one of the predefined winning symbol combinations. A win counter is provided for accumulating and storing the number of game wins. The game controller also includes a random number generator for generating a multiple payout random number. A comparator compares the number of accumulated wins stored in the win counter with the multiple payout random number. When these two values are equal and the game ends in a winning symbol combination, a payout control causes the device to payout the number of tokens corresponding to a multiple payout.

The comparator also compares the number of accumulated wins with the number equal to the multiple payout random number minus one. If the number of accumulated wins is less than the multiple payout random number by one, a multiple payout indicator is enabled by the game controller to display a multiple payout message to the player. This message indicates that a multiple payout will be made on the next win. Alternatively, a comparison is made to determine the number of wins which must be accumulated before a win will result in a multiple payout and this number is displayed to the player in the multiple payout message.

BEST MODE FOR CARRYING OUT THE INVENTION

Figure 1:
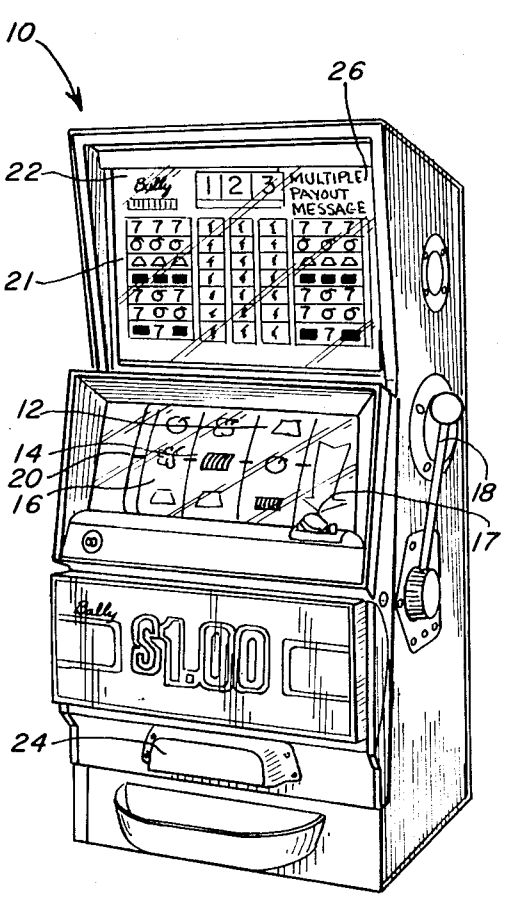
FIG. 1 is a perspective view of a gaming device in accordance with the present invention.

Referring to FIG. 1, a gaming device 10 is shown. The gaming device includes three symbol bearing reels 12, 14 and 16 (or a video display representation thereof). To operate the device, a player inserts one or more tokens into a slot 17 and pulls a handle 18. Pulling the handle will start the symbol bearing reels rotating. After a certain length of time (usually determined by a random number generator), the reels will sequentially come to a stop and a certain combination of symbols will appear adjacent to a win line 20. If the combination of symbols stopped on the win line matches one of a number of predefined combinations, a win occurs and the machine will dispense a specified number of tokens via a payout chute 24. The number of tokens dispensed for a win is controlled in relation to the odds that a particular combination will occur and the number of tokens inserted by the player. The number of tokens dispensed for a certain symbol combination and a specified number of inserted tokens is shown by a chart 21 displayed on a payout glass 22.

Figure 2:
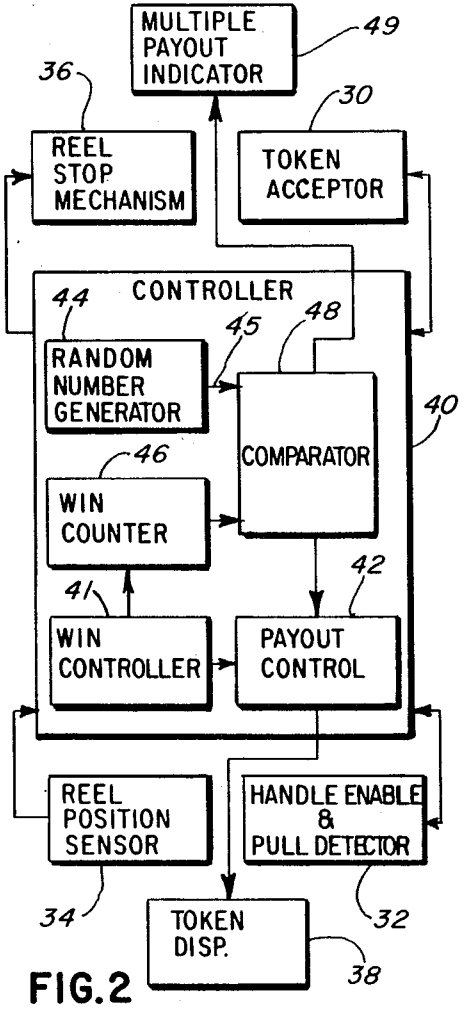
FIG. 2 is a block diagram illustrating the game controller of the present invention having random multiple payouts.

As shown in FIG. 2, the gaming device includes a token acceptor 30, a handle enable and handle pull detector 32, a reel position sensor 34, a reel stop mechanism 36 and a token dispenser 38. All of these electronic and/or mechanical mechanisms are coupled to a controller 40. The controller preferably includes a microprocessor and associated memory. However, discrete electronic circuitry can also be utilized. In either case, the controller performs the following main functions: (1) monitoring the token acceptor 30 to determine the number of tokens inserted; (2) enabling the handle 18 to be pulled by the player after the correct number of tokens have been inserted; (3) controlling the reel stop mechanism 36 to stop each of the reels in a random position a predetermined length of time after they are set in motion by the handle pull; (4) determining the positions at which the reels have stopped; and (5) comparing the final reel positions with a predefined set of symbol combinations to determine if a win has occurred. These functions may be performed by the win controller 41. The controller 40 also includes a payout control 42 for controlling the token dispenser 38 to dispense the appropriate number of tokens for a given winning symbol combination. The specifics of the controller described above may be such as illustrated in U.S. Pat. No. 4,238,127 or U.S. Pat. No. 4,095,795, both of which are incorporated by reference.

In order to provide the multiple payout feature of the present invention, the controller 40 includes a random number generator 44 which outputs a multiple payout random number on line 45. A win counter 46 is responsive to the win controller 41 for counting and storing the number of winning games. The output of the win counter 46 is coupled to a comparator 48 which compares the multiple payout random number on line 45 to the number of accumulated wins stored in the win counter. If these two numbers are equal as determined by the comparator 48 and if the reels stop in a winning symbol combination after a regular game sequence as determined by the win controller 41, the payout control 42 causes the token dispenser 38 to dispense the appropriate number of tokens corresponding to a multiple payout rather than the number of tokens corresponding to a regular payout. If the multiple win random number does not equal the number of accumulated wins and a win occurs, a regular payout is made. Of course, if a win does not occur, i.e. if a game ends in a non-winning symbol combination, no payout is made regardless of whether or not the multiple win random number equals the number of accumulated wins.

A multiple payout is a win combination in which the number of tokens paid out for a win is multiplied by a specific amount. For example, if a regular payout for the winning symbol combination of CHERRY-CHERRY-BAR would yield three tokens for one inserted token, a multiple payout would yield nine tokens for the same winning symbol combination and one inserted token. The number by which a regular payout is multiplied to yield a multiple payout may be a constant (three in the example just given) permanently programmed into the controller. On the other hand, the multiplicand itself may be a random number.

In accordance with the present invention, the gaming device 10 also provides an indication that a future (illustratively the next) winning symbol combination will yield a multiple payout. To provide such an indication, a multiple payout indicator 49 is coupled to the controller 40 as illustrated in FIG. 2. The multiple payout indicator, in its simplest form, is merely a lamp located behind the payout glass 22 (FIG. 1). In which case a multiple payout message 26 such as "Multiple Payout Will Occur On Next Win" is printed on the glass and is visible only if the multiple payout indicator lamp 49 is enabled, i.e., lit. If the multiple payout indicator is not enabled by the controller 40, the multiple payout message 26 is not visible. When the multiple payout indicator 49 is enabled to make the multiple payout message 26 visible, a gaming device player is informed that the next winning symbol combination will yield a multiple payout. Thus, if the multiple payout message 26 is visible, a player who might have otherwise lost interest in playing the gaming device will be encouraged to continue playing in order to reap the benefits of a multiple payout.

Figure 3:
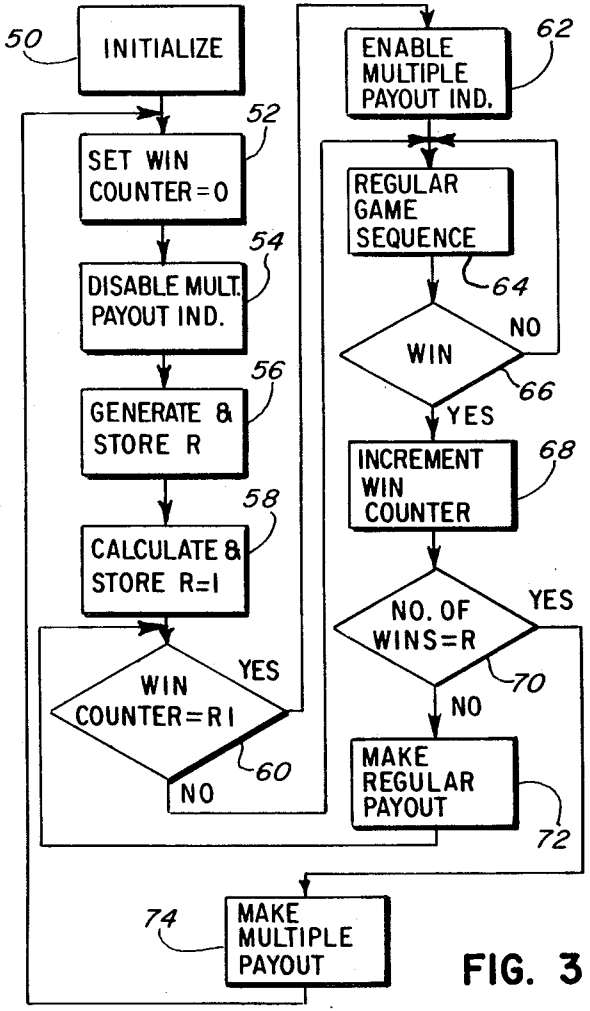
FIG. 3 is a flowchart illustrating the random multiple payout feature of the present invention.

Referring to FIG. 3, a flow diagram of the control functions relating to the multiple payout feature is illustrated. After the gaming device is initialized as indicated in a block 50, the win counter 46 is set to zero as shown in block 52 and the multiple payout indicator 49 is disabled as illustrated in a block 54. Next, the random number generator 44, at block 56, generates and stores the multiple payout random number R. At block 58 the number 1 is subtracted from the random number to yield the number R-1 and this latter value is also stored.

A check is then made by the comparator 48 at block 60 to determine whether the number R-1 is equal to the value stored in the win counter 46. If the values are equal, the multiple payout indicator 49 is enabled as illustrated in a block 62. It is at this point that the player is informed by the multiple payout message 26 that the next win will yield a multiple payout. If the comparison in block 60 determines that the win counter value is not equal to the value R-1, block 62 is bypassed and a regular game sequence as indicated at block 64 is commenced.

At this point (block 64), all of the regular game functions, up to and including determining the final reel positions, are executed by the controller 40. After the reels have been stopped in the appropriate location, a block 66 then determines whether the reels have stopped at one of the predefined winning symbol combinations. If a win did not result from that game, a return is made to block 64 so that a player may initiate another game sequence.

If at block 66 it was determined that a win did result, the win counter 46 is incremented as illustrated in a block 68. A comparison is then made at a block 70 to determine whether the number of accumulated wins (including the one just recorded) is equal to the multiple payout random number R. If the values are not equal, a regular payout is made as indicated by a block 72 and a return is made to block 60 to determine whether the multiple payout indicator 49 should be enabled by block 62.

Returning to block 70, if the number of accumulated wins is equal to the random number R, a multiple payout is made as illustrated at a block 74. After a multiple payout is made, a return is made to block 52 so that the entire process can be repeated as described above.

From the flow diagram in FIG. 3, it can be seen that the multiple win random number R controls the number of wins that must occur before a multiple payout is made. It can also be seen that the multiple payout indicator 49 is enabled to display the multiple payout message 26 when the number of wins accumulated since initialization or since the last multiple payout was made is equal to the number $R-1$.

Rather than merely indicating that a multiple payout will be made on the next win, it may be desirable to indicate to the player the number of wins which must be accumulated before a win will result in a multiple payout. To do this, the previously described embodiment is modified so that the multiple payout message 26 reads, "A Multiple Payout Will Be Made X Win(s) From Now." The controller 40 in combination with the multiple payout indicator 49 assigns a specific value to X. This value is decremented by one every time a game results in a win until finally a winning game yielding a multiple payout occurs.

In order to make this modification, block 60 in FIG. 3 is altered to calculate the difference between the multiple payout random number R and the number of accumulated wins. A modified block 62 then causes the number representing this difference to be displayed in the multiple payout message 26 by the multiple payout indicator 49. In this embodiment, the multiple payout indicator 49 includes a seven segment LED, or the like, to display the number calculated by modified block 60 in the multiple display message 26. Also, in this modification, blocks 54 and 58 in FIG. 3 are eliminated. In this embodiment, it may be desirable not to have the gaming device display any multiple payout message unless the number to be displayed is less than a specific number, e.g. 6.

Another modification of the previously described embodiment consists of generating a separate multiple payout random number and providing a corresponding win counter for each winning symbol combination. The number one is subtracted from each of the multiple payout random numbers (to yield the corresponding number R−1) and compared to the number of accumulated wins for the corresponding winning symbol combination. When the number of accumulated wins equals the number R−1 for a particular winning symbol combination, a corresponding multiple payout indicator is enabled.

Rather than having one multiple payout indicator 49 for one multiple payout message 26, there is a multiple payout indicator lamp located behind each of the winning symbol combinations shown in the chart 21 displayed on the payout glass 22 (FIG. 1). When a particular multiple payout indicator lamp is enabled to light up the corresponding symbol combination in chart 21, an indication is made to the player that the next game ending in that particular winning symbol combination will yield a multiple payout.

While the invention has been described by way of examples, it will be understood that it is not intended to limit the invention to these examples. On the contrary, it is intended to cover all alternatives, modifications and equivalents as may be included within the spirit and scope of the invention as defined by the appended claims.

I claim:

1. In a gaming device having a first random means for determining a win in response to a player input and means for providing a payout to the player in response to a win determination, apparatus for providing an indication of future random multiple payouts comprising:

counter means increments in response to said win determination for providing a count representing the number of win determinations;

second random means for generating a multiple payout random number;

means for comparing the win determination count to the multiple payout random number to determine whether said count equals said number;

means responsive to said first random means and said comparing means for controlling the payout means to provide a multiple payout to the player if the win count equals the multiple payout random number;

means for indicating a multiple payout; and means for enabling said multiple payout indicating means to provide an indication that a multiple payout will be made for a win determination which occurs after a predetermined number of wins has occurred.

2. The gaming device of claim 1 wherein the multiple payout indicating means includes means for displaying to the player a message associated with a multiple payout.

3. The gaming device of claim 1 further including second means for comparing the win determination count to the multiple payout random number minus one to determine whether said count is one less than said random number and wherein said indicator enabling means includes means responsive to said second comparing means for enabling said multiple payout indicating means to provide an indication that a multiple payout will be made on the next win.

4. The gaming device of claim 1 further including means for determining the difference between said win determination count and the multiple payout random number and wherein said indicator enabling means includes means responsive to said difference determining means for controlling said multiple payout indicating means to provide an indication of the number of wins which must occur before a multiple payout is made.

5. In a gaming device having a means for displaying a plurality of symbols in response to a player controlled input, a means for determining whether the plurality of symbols include a winning combination of symbols and a means for paying out to the player a specified number of tokens in response to a determination that the symbols include a winning combination, apparatus for providing an indication of future random multiple payouts comprising:

means responsive to said winning combination determinging means for counting the number of determined winning combinations to provide a count representative thereof;

means for generating a random number;

means for comparing said count to said random number;

means responsive to said comparing means and said winning combination determining means for controlling the payout means to provide a number of tokens which is a multiple of said specified number if said count equals said random number for a winning symbol combination;

means for indicating a multiple payout; and meaas for enabling multiple payout indicating means to provide an indication that a multiple payout will be made for a win determination which occurs after a predetermined number of wins has occurred.

6. The gaming device of claim 5 wherein the number by which the specified number is multiplied if said count equals said random number for a winning symbol combination is selected at random.

7. The gaming device of claim 5 wherein the multiple payout indicating means includes means for displaying to the player a message associated with a multiple payout.

8. The gaming device of claim 5 further including second means for comparing the win determination count to the random number minus one to determine whether said count is one less than said random number and wherein said indicator enabling means includes means responsive to said second comparing means for enabling said multiple payout indicating means to provide an indication that a multiple payout will be made on the next win.

9. The gaming device of claim 5 further including means for determing the difference between said win determination count and said random number and wherein said indicator enabling means includes means responsive to said difference determining means for controlling said multiple payout indicating means to provide an indication of the number of wins which must occur before a multiple payout is made.

10. A method for providing an indication of future multiple random payouts in a gaming device having a means for determining a win in response to a player input and a means for providing a payout to the player in response to a win determination comprising:

counting said determined wins to provide a count representative thereof;

generating a multiple payout random number;

comparing the determined wins count to said multiple payout random number;

controlling the payout means to provide a multiple payout to the player if said count equals said random number; and indicating that a multiple payout will be made for a win determination which occurs after a predetermined number of wins has occurred.

11. The method of claim 10 further including determining if said determined win count is one less than said multiple payout random number and wherein said indicating step indicates that a multiple payout will be made for the next win if said determined win count is one less than said multiple payout random number.

12. The method of claim 10 further including determining the difference between said determined win count and said multiple payout random number and said indicating step indicates to the player the number of wins which must occur before a multiple payout is made.

* * * * *